United States Patent [19]

van Mensvoort et al.

[11] 4,288,993

[45] Sep. 15, 1981

[54] REFRIGERATOR

[75] Inventors: Adrianus J. van Mensvoort; George A. A. Asselman, both of Eindhoven, Netherlands

[73] Assignee: U.S. Philips Corporation, New York, N.Y.

[21] Appl. No.: 77,956

[22] Filed: Sep. 24, 1979

[30] Foreign Application Priority Data

Oct. 5, 1978 [NL] Netherlands ..... 7810047

[51] Int. Cl.[3] ..... F25D 11/02

[52] U.S. Cl. ..... 62/333; 62/292; 165/26

[58] Field of Search ..... 62/292, 294, 175, 333; 165/96, 32

[56] References Cited

U.S. PATENT DOCUMENTS

| | | | |
|---|---|---|---|
| 2,536,001 | 12/1950 | Chase | 62/294 X |
| 2,667,760 | 2/1954 | Curtis | 62/292 |
| 2,702,993 | 3/1955 | Harris | 62/292 |
| 3,167,159 | 1/1965 | Bovenkerk | 165/32 X |
| 3,289,426 | 12/1966 | Music | 62/292 X |
| 3,958,627 | 5/1976 | Edelstein | 165/32 |

FOREIGN PATENT DOCUMENTS

| | | | |
|---|---|---|---|
| 618816 | 2/1949 | United Kingdom | 62/175 |

*Primary Examiner*—William E. Tapolcai, Jr.

*Attorney, Agent, or Firm*—Thomas A. Briody; William J. Streeter; Rolf E. Schneider

[57] ABSTRACT

A refrigerator comprises a primary refrigerating system and a secondary refrigerating system in heat-exchanging contact with each other. The secondary refrigerating system is connected to a reservoir containing a control gas getter which can be heated to vary the amount of free control gas in the secondary refrigerating system and thereby to control the temperature of the secondary refrigerating system. The reservoir includes an initially breakable seal for aiding in assembling the reservoir to the secondary refrigerating system.

2 Claims, 5 Drawing Figures

REFRIGERATOR

Figure 1:
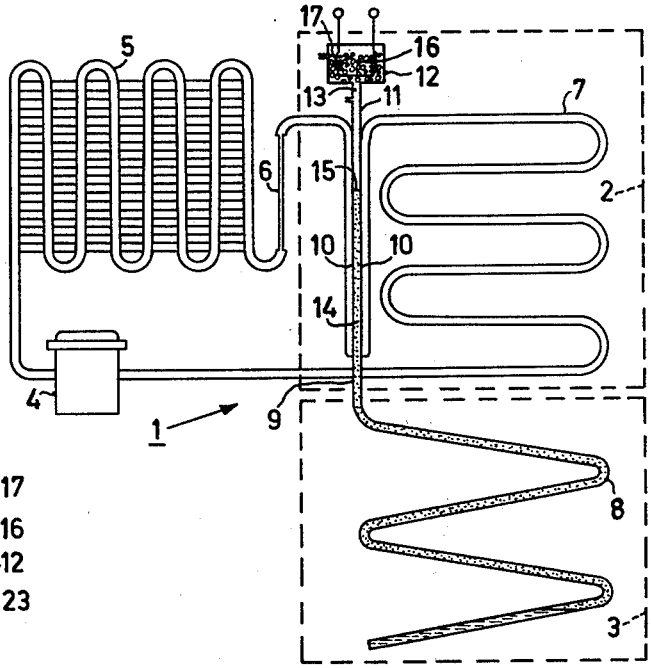
Figure 2:
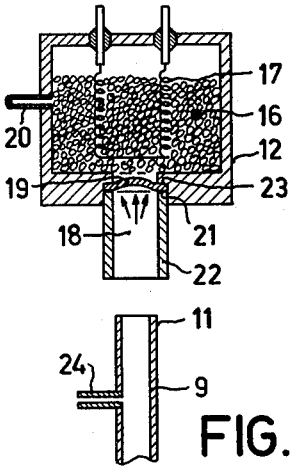

This invention relates to a refrigerating device having a freezing compartment and a refrigerating compartment, which refrigerating device is provided with a primary refrigerating system containing a primary refrigerant and having a primary evaporator disposed in the freezing compartment, and with a secondary refrigerating system containing a secondary refrigerant and a control gas, latter system is constituted by a secondary evaporator pipe disposed in the refrigerating compartment, which pipe is closed at one end and at the other end is connected to a secondary condensor pipe which is in heat exchanging contact with the primary evaporator, which secondary condensor pipe is connected to a supply duct of a reservoir containing a reversible control gas getter which can be heated for varying the amount of free control gas, so as to control the temperature of the secondary evaporator pipe.

Such a refrigerating device is described in the nonprepublished Netherlands Patent Application No. 911,400 filed June 1, 1978, now U.S. Pat. No. 4,258,554.

A problem which occurs in the manufacture of such a refrigerating device is that before the reservoir containing the control gas getter is connected to the secondary condenser pipe, the control gas getter can absorb water and other substances from the ambient air, which later may have an adverse effect on the operation of the refrigerator. During such manufacturing process the required amount of control gas getter for each reservoir must therefore first be subjected to a time consuming drying and degassing operation.

It is an object of the present invention to provide a solution for this problem. To this end the refrigerating device in accordance with the invention is characterized in that the supply duct of the reservoir includes a breakable seal.

The advantage of this arrangement is that by closing the reservoir with a seal, the reservoir can be manufactured in a separate production step and at a separate location. This method is extremely suitable for mass production. Moreover, a larger amount of control gas getter is enabled to be dried and degassed at one time. Subsequently, the reservoir may be stored without any problems until it is needed for the manufacture of the refrigerating device. After connection of the reservoir to the secondary condensor pipe, the seal need only be ruptured, for example by raising the pressure, so that automatically an open connection is obtained between the condensor pipe and the reservoir. Raising the pressure can be effected in different manners. Preferably, a copper foil is used as the breakable seal.

In one embodiment the refrigerating device is provided with a cartridge, said cartridge comprising the reservoir, which has been evacuated, the supply duct of said reservoir including a breakable seal, and said reservoir containing the reversible control gas getter.

In another embodiment the refrigerating device is provided with a cartridge, said cartridge comprising the reservoir, said reservoir containing the control gas, the supply duct of said reservoir including a breakable seal, and said reservoir containing the reversible control gas getter.

In still another embodiment the refrigerating device is provided with a cartridge, said cartridge comprising the reservoir, said reservoir containing both the control gas and a small amount of refrigerant, the supply duct of said reservoir including a breakable seal, and said reservoir containing the reversible control gas gatter.

The invention relates also to the cartridge which is applicable in the refrigerating device.

The invention will now be described in more detail with reference to the accompanying drawings, in which:

FIG. 1 schematically represents the two refrigerating systems in the refrigerating device.

FIGS. 2 to 5 show how the breakable seal mounted in the reservoir is ruptured during the manufacturing process.

In FIG. 1 reference numeral 1 refers to a refrigerator, which comprises a freezing compartment 2 and a refrigerating compartment 3. In this case the freezing compartment 2 is disposed above the refrigerating compartment 3.

The freezing compartment 2 is cooled by means of a primary refrigerating system which comprises a compressor 4, a primary condensor 5, a capillary 6 serving as a restriction, and a primary evaporator 7. The primary refrigerating system contains a normal refrigerant, such as Freon. The temperature in the freezing compartment 2 is thermostatically controlled and the temperature level is adjustable in known manner, not indicated.

The refrigerating compartment 3 is cooled by means of a secondary refrigerating system, whose secondary evaporator 8 is located in the refrigerating compartment 3 and whose secondary condensor 9 is located in an insulated outer wall of the freezing compartment 2. The secondary condensor 9 has a condensation wall 10, which is brought into thermally conducting contact with the primary evaporator 7. The secondary refrigerating system also contains a normal refrigerant, such as Freon. The secondary evaporator 8 and the secondary condensor 9 are constituted by a single pipe. Heat transfer in the secondary refrigerating system is obtained in that the liquid refrigerant evaporates in the secondary evaporator 8 and subsequently condenses on the surface of the condensation wall 10. The condensed refrigerant flows back into the secondary evaporator 8 as a result of the force of gravity and in this way cools the refrigerating compartment 3.

The temperature in the refrigerating compartment 3 is controlled by varying the available condensation wall area 10. For this purpose the end 11 of the secondary condensor 9 terminates in a reservoir 12 which is filled with a control gas 13. This control gas 13 forms an interface 15 with secondary the refrigerant vapour 14 at the location of the condensation wall 10. During operation condensation of refrigerant vapour takes place below said interface 15, whilst above it no condensation takes place. The position of the interface 15 determines the size of the available condensation wall area, hence the amount of refrigerant which condenses and thus also the temperature of the secondary evaporator 8.

The interface 15 can be moved along the condensation wall 10 by varying the amount of control gas 13. For this purpose the reservoir 12 contains a reversible control gas getter 16, which can be heated. At increasing temperatures the control gas getter releases more control gas and the interface 15 moves downwards, so that the available surface area of the condensation wall 10 is reduced. Conversely, the control gas getter will absorb more control gas at decreasing temperatures, so that the interface 15 is moved upwards and the available condensation wall area increases. As the secondary refrigerant is for example made of Freon R12 ($CF_2Cl_2$), as control gas nitrogen, and as control gas getter the well-known molecular filter material zeolite type 4A. This type of zeolite getters nitrogen, but substantially no Freon R12. Of course other combinations are also possible. The control gas getter 16 may be heated with the aid of a heating element 17, which is included in a known control circuit, not shown.

During the manufacture of the reservoir 12 the required amount of dried and degassed control gas getter 16 can be put into the reservoir and subsequently the supply duct 18 of the reservoir can be sealed hermetically by the seal 19. Another possibility is to fill the reservoir 12 with the required amount of control gas getter in non-purified form, subsequently to seal the supply duct 18 of the reservoir with the seal 19, and then to heat the reservoir, water vapour and gases being discharged via a separate discharge tube 20.

FIGS. 2 to 5 show how the breakable seal is ruptured during the production process. The breakable seal 19, for example a copper foil, is arranged between the end 21 of a supply pipe 22 and the rim 23 of the reservoir 12. The reservoir is evacuated by connecting a vacuum pump, not shown, to the discharge tube 20. Subsequently, the discharge tube is closed by soldering. Thus, a getter container in the form of a cartridge is obtained, which may readily be kept until it is needed in the production process. Obviously, the breakable seal may also be arranged somewhere in the supply pipe 22.

Figure 3:
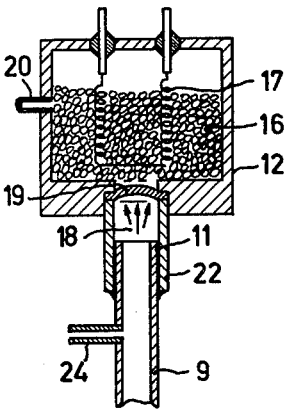
Figure 4:
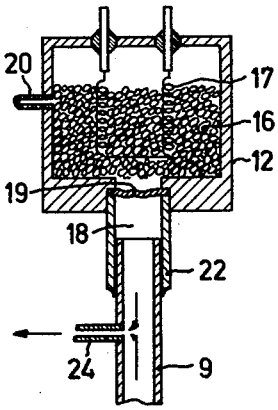
Figure 5:
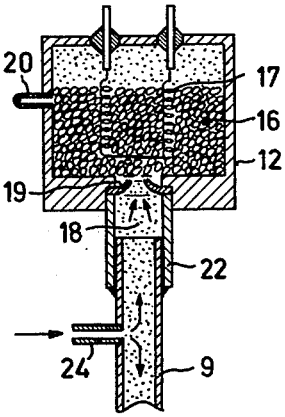

In the production process the end 11 of the secondary condensor pipe 9 is soldered to the supply pipe 22 (see FIG. 3). Subsequently, the secondary refrigerating system is evacuated via a pipe 24 (see FIG. 4) and then filled with a Freon and a control gas, the seal being ruptured as a result of the Freon pressure (approx. 5 bar), so that automatically an open connection is obtained between the reservoir 12 and the secondary condensor pipe 9 (see FIG. 5). Subsequently, the pipe 24 is closed by soldering. The ruptured seal remains in the supply duct 18, but does not impair the correct operation of the refrigerating system.

Another possibility is to fill the reservoir 12 with a control gas instead of evacuating it. In that case the seal will rupture when the reservoir is heated after assembly, for example when the insulating material is mounted in the wall of the refrigerator. The control gas getter then releases sufficient control gas so that the pressure in the reservoir exceeds the rupturing pressure of the seal.

It is alternatively possible to fill the reservoir with a small amount of Freon in addition to the control gas. When this method is used the seal will rupture in any case after the secondary refrigerating system is put into operation. When the refrigerator is put into use at the maximum refrigerating capacity the control circuit of the secondary refrigerating system ensures that the heating element 17 is switched on, so that as a result of the evaporation of the Freon the pressure in the reservoir will increase until the seal is ruptured. If for example Freon R12($CF_2Cl_2$) is heated to 100° C. in a closed space, the vapour pressure will be 33 bar. The advantage of this last mentioned method is that the rupturing pressure of the seal can be selected higher. This for example allows the use of a thicker copper foil.

What is claimed is:

1. A refrigerator comprising a freezing compartment; a refrigerating compartment; a primary refrigerating system containing a primary refrigerant and including a primary evaporator disposed in the freezing compartment; a secondary refrigerating system containing a secondary refrigerant and a control gas and including a secondary evaporator disposed in the refrigerating compartment and a secondary condensor disposed in the freezing compartment in heat-exchange contact with the primary evaporator, said secondary refrigerating system being constituted as a tube closed off at the outer end of the secondary evaporator portion thereof; a reservoir containing a reversible control gas getter and having a supply duct connected to the outer end of the secondary condensor portion of the secondary refrigerating system tube; and a breakable seal arranged in the supply duct of the reservoir to enable the reservoir to be connected to said secondary condensor portion without contamination of the control gas getter.

2. A refrigerator according to claim 1, in which the breakable seal is formed of copper foil.

* * * * *